US006113506A

United States Patent [19]

Nielsen

[11] Patent Number: 6,113,506

[45] Date of Patent: Sep. 5, 2000

[54] POOLSIDE BASKETBALL GOAL

[76] Inventor: Gary Kenneth Nielsen, 933 N. Hazelton Ct., Chandler, Ariz. 85226

[21] Appl. No.: 09/126,641

[22] Filed: Jul. 31, 1998

[51] Int. Cl.[7] ..... H63B 63/08

[52] U.S. Cl. ..... 473/466; 473/479; 473/483

[58] Field of Search ..... 473/472, 479, 473/481, 483, 485, 487, 466

[56] References Cited

U.S. PATENT DOCUMENTS

| | | | |
|---|---|---|---|
| 2,818,254 | 12/1957 | Dunn | 473/481 |
| 3,743,286 | 7/1973 | Weinhagen | 473/481 |
| 4,307,887 | 12/1981 | Weiss . | |
| 4,613,136 | 9/1986 | Raba | 473/483 |
| 4,715,599 | 12/1987 | Raymond et al. . | |
| 4,759,545 | 7/1988 | Grable . | |
| 4,973,054 | 11/1990 | Metrosky . | |
| 5,037,093 | 8/1991 | Roark, Jr. . | |
| 5,112,023 | 5/1992 | Sowers . | |
| 5,149,086 | 9/1992 | Zift . | |
| 5,316,315 | 5/1994 | Roark, Jr. . | |
| 5,632,480 | 5/1997 | Davis et al. . | |

*Primary Examiner*—Jeanette Chapman
*Assistant Examiner*—M. Chambers

[57] ABSTRACT

A lightweight poolside basketball goal that easily mounts to the side of an in-ground swimming pool. The poolside basketball goal will attach to a standard size volleyball or basketball sleeve in the pool deck. The poolside basketball goal can also be used with a weighted ballast, instead of with a sleeve. The basketball goal easily attaches to the side of a pool, utilizing the underside of the pool deck overhang, in such a manner that the basketball bounces off of the goal as if it were a conventional basketball goal.

6 Claims, 4 Drawing Sheets

POOLSIDE BASKETBALL GOAL

FIELD OF THE INVENTION

The present invention relates to basketball goals, and specifically to an improved anchoring system for a poolside basketball goal.

BACKGROUND INFORMATION

Basketball is one of the most popular sports in the United States. The popularity of basketball is so widespread, it is even played in swimming pools. There are a number of basketball goals in the prior art that are designed for use with swimming pools. For example, U.S. Pat. No. 5,037,093 to Roark, Jr. provides for a poolside basketball goal that is anchored more than three feet away from the pool. U.S. Pat. No. 4,759,545 to Grable discloses a portable basketball goal that is placed on the pool deck of a swimming pool. U.S. Pat. No. 4,307,887 to Weiss and U.S. Pat. No. 5,149,086 to Ziff disclose basketball goals that are used for above-ground pools. U.S. Pat. No. 4,715,599 to Raymond et al. and U.S. Pat. No. 4,973,054 to Metrosky disclose basketball goals that are attached to a swimming pool diving board.

While the above-mentioned basketball goals can be used in conjunction with a swimming pool, none of the prior art references provides for an easily transportable, lightweight, basketball goal that firmly attaches to an in-ground swimming pool in a manner that allows the basketball to come off of the goal with the same movement as a conventional basketball goal. The present invention is for in-ground swimming pools, and can be easily attached to the existing volleyball or basketball sleeve on the pool deck of the swimming pool. The present invention can also be used with a weighted ballast, instead of attached to the above mentioned sleeves. The present invention overcomes the problems of the prior art by being able to firmly, yet easily attach to the side of an in-ground swimming pool in a manner that allows for slam dunks and for the ball to bounce off the goal in a manner that is similar to a conventional basketball goal. The present invention hangs low over the swimming pool to allow for slam dunks to be easily made. The basketball goal of the present invention attaches to the pool deck firmly so that the goal has a minimum amount of movement when the basketball bounces off of it, and thus it plays like a conventional basketball goal. Furthermore, the present invention can be used with swimming pools that have a variety of sizes of sleeves, where the sleeves can be set at various distances from the edge of the swimming pool, and the edge of the swimming pool can be of varied thickness.

SUMMARY OF THE INVENTION

The present invention provides for a poolside basketball goal that is easily transportable, and firmly attaches to the side of an in-ground swimming pool in such a manner that the goal performs like a conventional basketball goal. The basketball goal has an attachment means that attaches the goal to the underside of the pool deck overhang and to a sleeve in the pool deck. Alternately, the basketball goal can be attached to a weighted ballast instead of a sleeve in the pool deck.

One object of the present invention is to provide for an improved poolside basketball goal that performs like a conventional basketball goal.

Another object of the present invention is to provide for a basketball goal that is secure and can withstand slam dunks.

These and other objects and features of the present invention will be described in the drawings and written description.

DESCRIPTION OF THE PREFERRED EMBODIMENT

Figure 1:
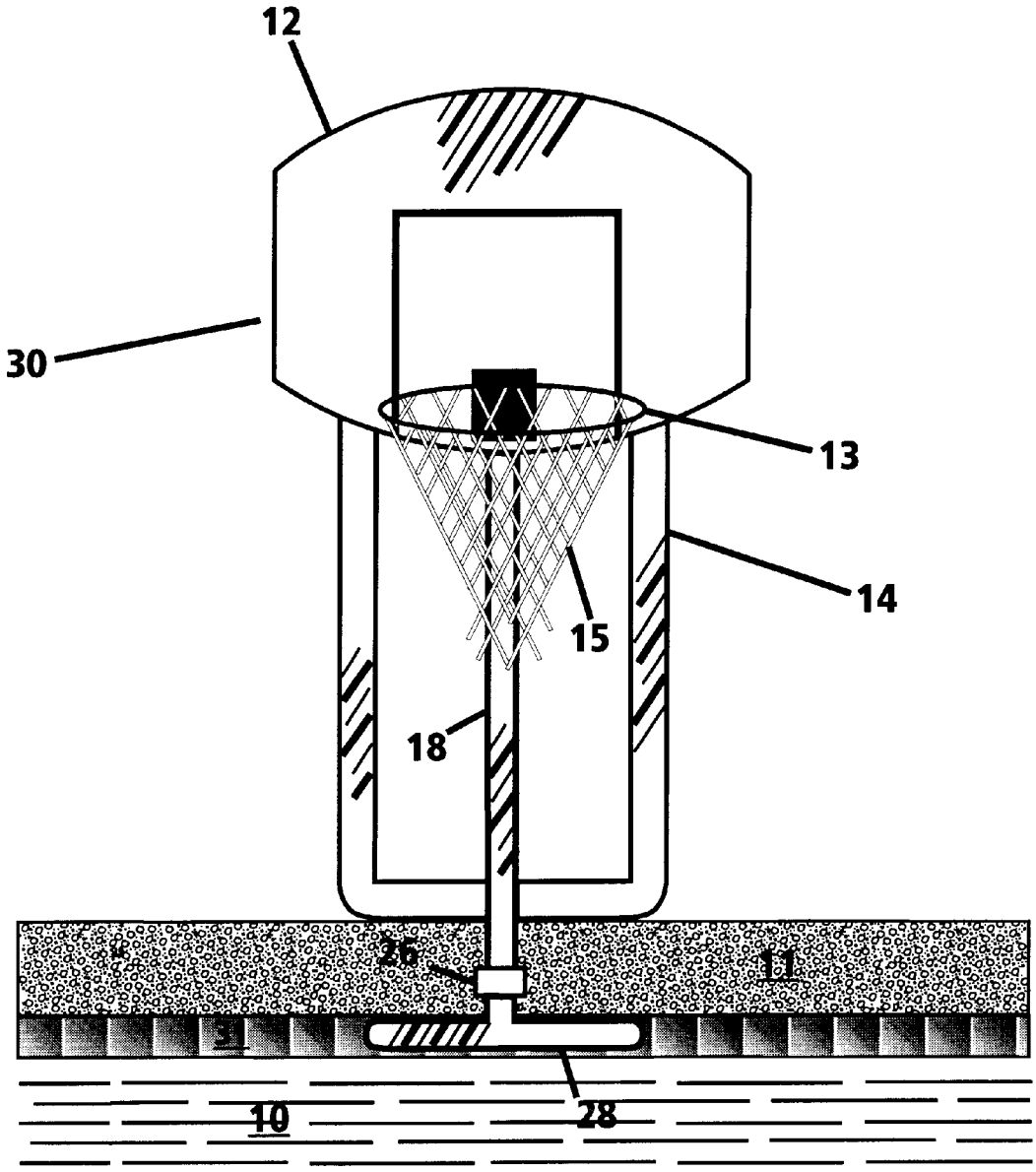
FIG. 1 is a front plan view of the poolside basketball goal of the present invention.

For the purpose of providing a description of the invention, reference will now be made to the drawings, and specific language will be used to describe the drawings. It is not intended that the scope of the invention is to be limited by the specific language of this description. FIG. 1 illustrates the poolside basketball goal 30 which is shown with in-ground swimming pool 10. Basketball goal 30 has a backboard 12, rim 13, and a net 15. The lightweight backboard 12 is a backboard that can be purchased at a sporting goods store. The rim 13 is typically attached to the backboard with metal screws. The diameter of the rim 13 can vary.

Figure 3:
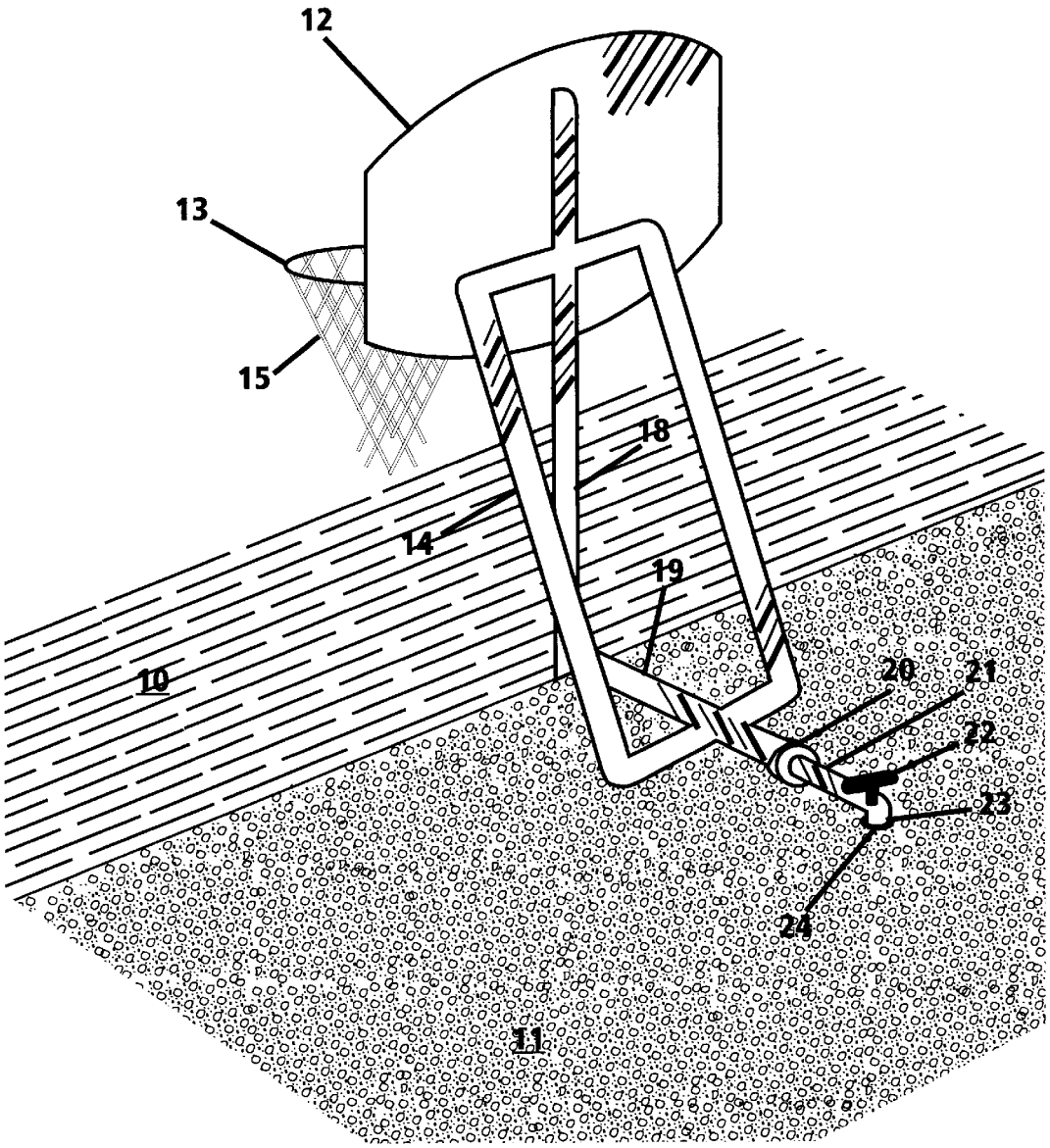
FIG. 3 is a perspective view of the present invention.

Referring to FIG. 3, it can be seen that the backboard 12 is supported by a rectangular frame member 14 and a support pipe 18. The backboard 12 is attached to the frame member 14 and support pipe 18 with a metal bracket or something similar that will firmly fix the backboard in-place. The frame member 14 is a rectangular tubular frame constructed of a lightweight material such as polyvinyl chloride (PVC) piping. Support pipe 18 is fixedly attached to the top horizontal portion of frame member 14. Support pipe 18 is also constructed of a lightweight material such as PVC piping. Support pipe 18 is attached to the backboard 12 so that they both lie in the same plane. Frame member 14 is attached to the backboard 12 so that there is a slight angle between the frame member 14 and the backboard 12.

Referring to FIG. 3, it can be seen that support pipe 18 extends up the back of backboard 12. At the bottom of support pipe 18, there is another pipe 19 that is fixedly attached support pipe 18. Referring to FIG. 3, it can be seen that pipe 19 extends back from support pipe 18 at a 90 degree angle. Pipe 19 is firmly attached to frame member 14 so that there is a slight angle between frame member 14 and pipe 19.

Figure 4:
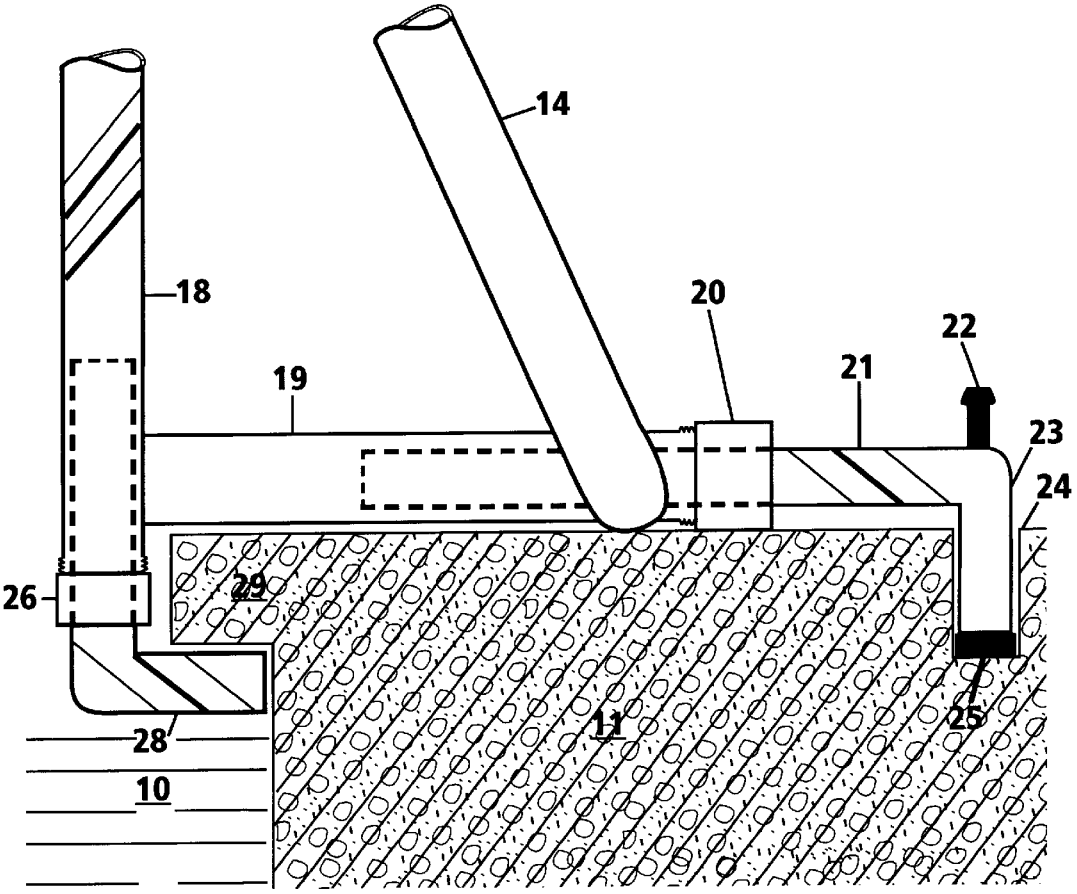
FIG. 4 is an exploded view of the preferred assembly for attaching the basketball goal to the side of the pool.

In FIG. 4, it can be seen that swimming pool 10 has a paved sidewalk 11 which typically contains a sleeve 24 of at least ½ inch in width. The sleeve 24 is usually wider than ½ inch in width and is used for anchoring poles for volleyball nets or basketball goals. The sleeve 24 is typically located 14 to 24 inches from the side of the pool, but it can be located even further from the pool. The bottom pipe 19 extends backwards towards the sleeve 24. Another pipe 21 is inserted into pipe 19 such that the total length of the two pipes can vary. Pipe 21 extends back from pipe 19 towards the sleeve 24. This allows for the sleeve 24 to placed at different distances from the side of the pool. There is an adjustment collar 20 that is used to secure pipe 21 into pipe 19, so that the basketball goal can be firmly attached to the side of the pool. Another pipe 23 extends downward from pipe 21 and secures the basketball goal into the sleeve 24. The knob 22 is used to compress and uncompress the rubber bushing 25 of pipe 23 so that it can fit more securely into sleeve 24.

If there is no sleeve available, then the basketball goal can be secured into a weighted container that is filled with sand or water.

Figure 2:
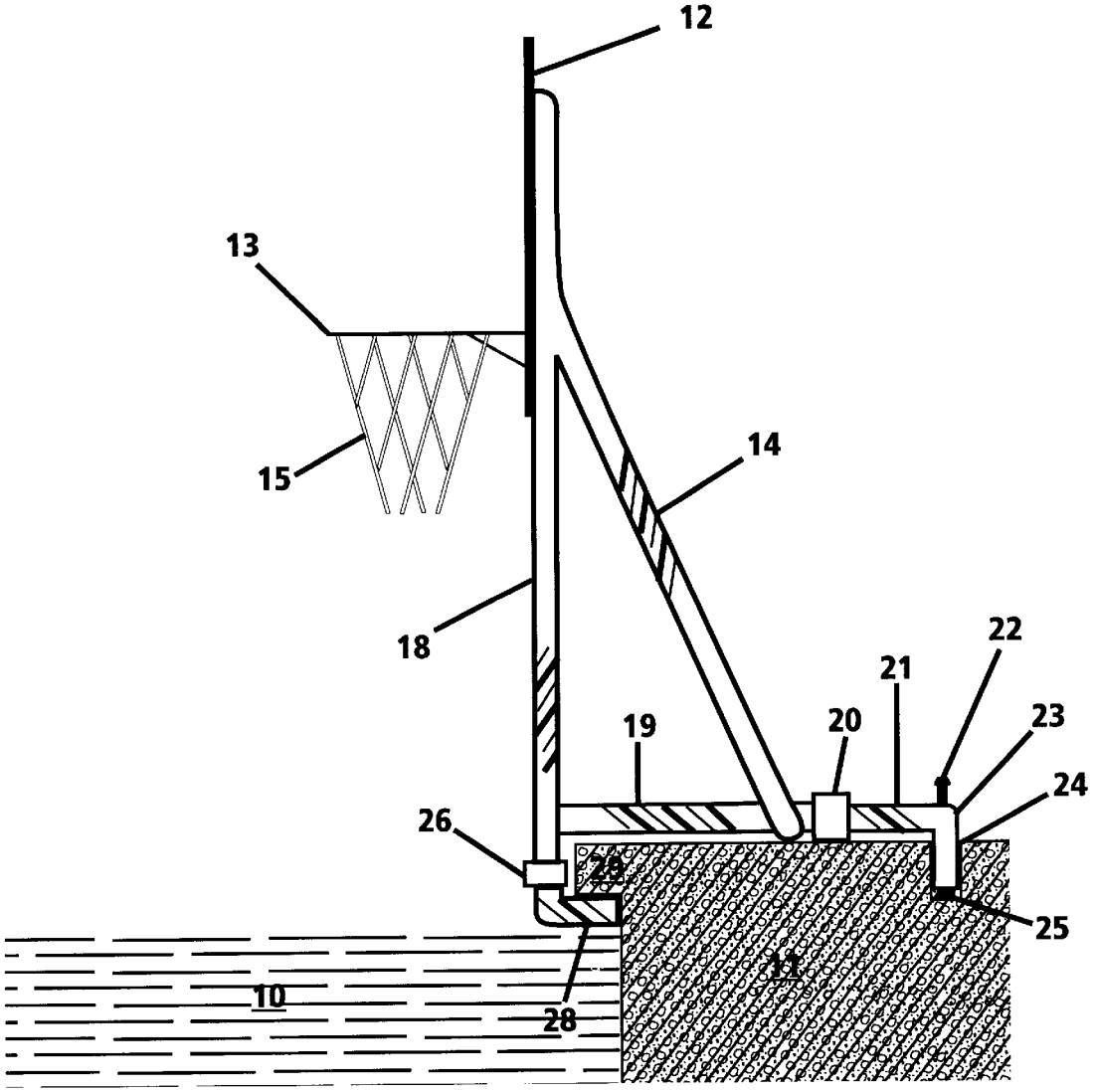
FIG. 2 is a side plan view of the present invention shown attached to the sleeve of a pool deck.

In FIG. 2, support pipe 18 extends downward into an adjustable collar 26. Pipe 28 fits into support pipe 18 and extends down from the adjustable collar 26. The adjustable collar 26 is used to adjust the length of pipe 28. Referring to FIG. 1, it can be seen that pipe 28 forms a "T" and it has two ends, where each end extends towards the side of the pool. Referring to FIG. 4, it can be seen that pipe 28 extends below the overhang 29 of the pool deck and attaches to the side of the pool just underneath the overhang 29. In this manner, the basketball goal 30 uses the underside of the pool deck overhang 29 and the sleeve 24 to lock firmly into place.

The basketball goal is mounted to a swimming pool in the following manner: (1) set the goal on the pool deck; (2) slide pipe 28 up against the underside of the pool deck overhang 29 so that pipe 28 is firmly against the side of the pool; (3) slide pipe 21 back out to the sleeve 24; (4) turn the front adjustment collar 26 and the rear adjustment collar 20 so that the pipes lock into place; (5) place the rear pipe 23 into the sleeve 24; and (6) tighten the knob 22 so that the rubber bushing 25 pipe 23 fits more securely into sleeve 24.

The basketball goal described here constitutes the preferred embodiment of the present invention. It is to be understood that the invention is not limited to the precise description of the basketball goal, and that changes may be made without departing from the scope of the invention defined in the attached claims.

What is claimed is:

1. A portable basketball goal for an in-ground swimming pool, including a backboard, with rim and net, a support frame, and an assembly for attaching the goal to the side of an in-ground swimming pool, said assembly comprising:

first attachment means for attaching said goal to underside of the pool deck overhang;

second attachment means for attaching said goal into a sleeve that is located in a pool deck.

2. The portable basketball goal as recited in claim 1, further comprising adjustment means for adjusting the length of said attachment means to accommodate different heights of pool deck overhangs.

3. The portable basketball goal as recited in claim 1, further comprising adjustment means for adjusting the length of said second attachment means to accommodate sleeves located at different lengths from side of swimming pool.

4. The portable basketball goal as recited in claim 2, further comprising adjustment means for adjusting the length of said second attachment means to accommodate sleeves located at different lengths from side of swimming pool.

5. The portable basketball goal as recited in claim 1, wherein said second attachment means attaches the goal to a weighted ballast.

6. The portable basketball goal as recited in claim 5, further comprising adjustment means for adjusting the length of said second attachment means to accommodate weighted ballast located at different lengths from side of swimming pool.

* * * * *